US006761274B1

(12) United States Patent
Chen

(10) Patent No.: US 6,761,274 B1
(45) Date of Patent: Jul. 13, 2004

(54) LOCATING STRUCTURE OF EXPANDABLE UNITS OF A RACK

(76) Inventor: Ching-Fei Chen, No. 43, Alley 19, Lane 189, Chang Ma Rd., Chang Hua City (TW)

( * ) Notice: Subject to any disclaimer, the term of this patent is extended or adjusted under 35 U.S.C. 154(b) by 0 days.

(21) Appl. No.: 10/358,469

(22) Filed: Feb. 6, 2003

(51) Int. Cl.[7] ..... A47B 47/00
(52) U.S. Cl. ..... 211/207; 211/204; 403/109.1
(58) Field of Search ..... 211/207, 175, 211/204, 105.1; 403/109.1, 109.2, 109.5; 280/79.3; 248/132, 149, 161, 410, 411, 412, 157

(56) References Cited

U.S. PATENT DOCUMENTS 5,433,551 A * 7/1995 Gordon ..... 403/377
5,492,430 A * 2/1996 Jones ..... 403/109.5
5,727,898 A * 3/1998 Lu ..... 403/325
5,823,699 A * 10/1998 Austin et al. ..... 403/109.1
5,876,011 A * 3/1999 Blasing ..... 248/411
6,003,696 A * 12/1999 Hsiu-Chen ..... 211/182
6,488,160 B2 * 12/2002 Wang ..... 211/195
6,520,192 B1 * 2/2003 Lo ..... 135/25.4

FOREIGN PATENT DOCUMENTS

DE 004020434 * 1/1991 ..... 211/207

* cited by examiner

*Primary Examiner*—Jennifer E. Novosad
(74) *Attorney, Agent, or Firm*—Charles E. Baxley

(57) ABSTRACT

A rack includes a horizontal framework for holding or displaying various things. The horizontal framework can be adjusted in height by a plurality of expandable units by which the horizontal framework is mounted on a base. The expandable units are formed of an outer tube, and an inner tube slidably fitted into the outer tube in conjunction with a locating structure having a cylindrical seat, a sleeve, and an elastic lock ring. The lock ring is retained in one end of the sleeve which is rotatably fastened to the cylindrical seat. The bottom end of the inner tube is slidably fitted into the top end of the outer tube and is embraced by the lock ring which is made compact to embrace tightly the bottom end of the inner tube when the sleeve is turned clockwise. The lock ring is relieved of the pressure when the sleeve is turned counter-clockwise.

2 Claims, 5 Drawing Sheets

LOCATING STRUCTURE OF EXPANDABLE UNITS OF A RACK

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a rack, and more particularly to a structure by which each of the expandable units of the rack is located securely.

BACKGROUND OF THE INVENTION

The adjustable racks of the prior art comprise a plurality of expandable units, each being formed of an outer tube and an inner tube slidably fitted into the outer tube. The racks can be thus adjusted in height by locating the inner tube inside the outer tube. The locating of the inner tube is done by a locating knob, which is turned to press against the outer wall of the inner tube. Such a locating means as described above is rather primitive and ineffective at best. The locating knob is apt to become loosened upon being impacted. In addition, the locating knob undermines the aesthetic effect of the racks. Moreover, the outer wall of the inner tube is susceptible to damage that is resulted from the mechanical friction between the locating knob and the inner tube.

BRIEF SUMMARY OF THE INVENTION

The primary objective of the present invention is to provide the expandable units of a rack with a locating structure which is free of the drawbacks of the locating means of the prior art racks described above.

In keeping with the principle of the present invention, the foregoing objective of the present invention is attained by a locating structure comprising a cylindrical seat, a sleeve, and a lock ring. The cylindrical seat is fitted over the top end of an outer tube of an expandable unit and is provided in the top end thereof with a tapered receptacle. The sleeve is rotatably fastened with the seat for retaining the lock ring which has a tightening portion of a tapered construction. The bottom end of an inner tube of the expandable unit is fitted into the top end of the outer tube via the lock ring and the sleeve. As the sleeve is turned clockwise in relation to the seat, the lock ring is carried along to move downward such that the tightening portion of the lock ring is forcibly contained in the receptacle of the top end of the seat. As a result, the bottom end of the inner tube is securely embraced by the tightening portion of the lock ring. When the sleeve is turned counterclockwise, the lock ring is carried along to move upward such that the tightening portion of the lock ring is no longer forcibly contained in the receptacle of the seat. As a result, the bottom end of the inner tube is no longer intimately embraced by the tightening portion of the lock ring and can be therefore moved up and down inside the outer tube.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
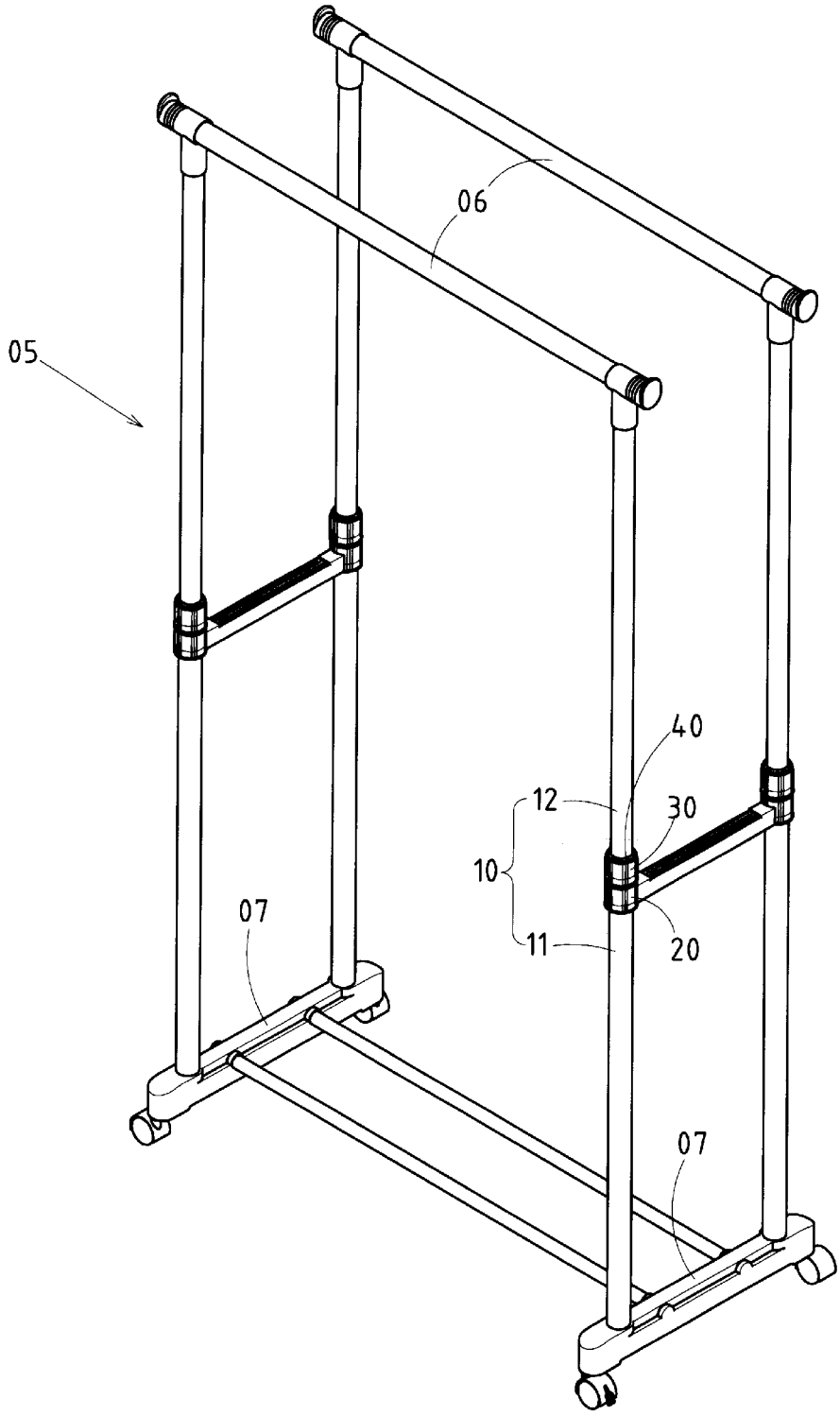
FIG. 1 shows a perspective view of the preferred embodiment of the present invention.
Figure 2:
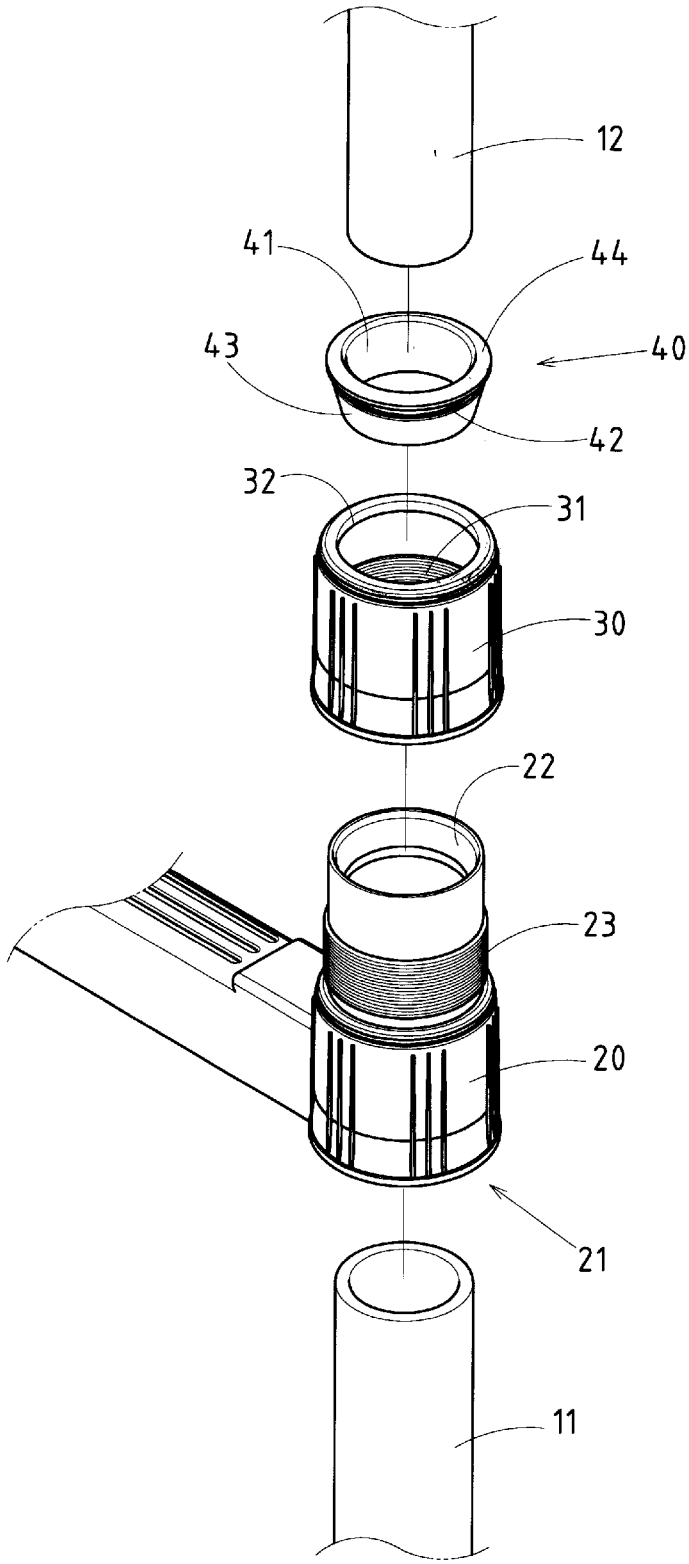
FIG. 2 shows an exploded perspective view of the expandable unit of the preferred embodiment of the present invention.
Figure 3:
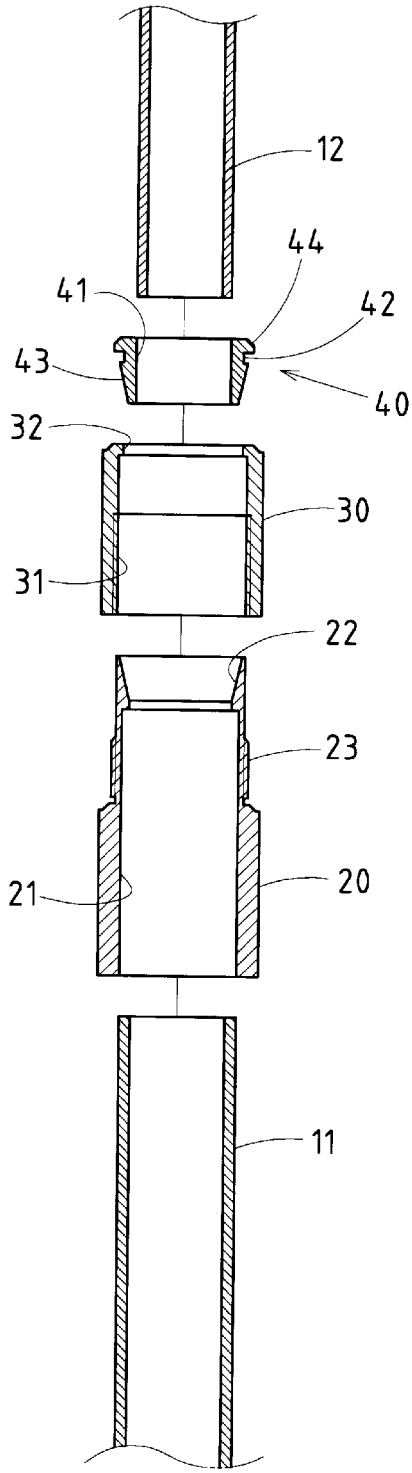
FIG. 3 shows an exploded sectional view of the expandable unit of the preferred embodiment of the present invention.

As shown in FIGS. 1–3, a coat rack 05 embodied in the present invention comprises a base 07, two horizontal bars 06, and four expandable units 10 which are uprightly mounted on the base 07 for supporting adjustably the two horizontal bars 06. The two horizontal bars 06 are used to hold a plurality of coat hangers. The two horizontal bars 06 can be adjusted in height, thanks to the expandable units 10.

The four expandable units 10 are formed of an outer tube 11, an inner tube 12, and a locating structure comprising a cylindrical seat 20, a sleeve 30, and a lock ring 40. The outer tube 11 is uprightly fastened at the bottom end with the base 07 and is fitted at the top end into the bottom end of the cylindrical seat 20. The inner tube 12 is fastened at the top end with one end of the horizontal bar 06 and is slidably fitted at the bottom end into the top end of the outer tube 11 through the cylindrical seat 20 in conjunction with the sleeve 30 and the lock ring 40 by which the bottom end of the inner tube 12 is securely located inside the top end of the outer tube 11.

As shown in FIGS. 2 and 3, the cylindrical seat 20 is provided in the interior with a longitudinal slot 21 dimensioned to accommodate the top end of the outer tube 11. The cylindrical seat 20 is further provided at the top end with a tapered receptacle 22 in communication with and in alignment with the longitudinal slot 21. The cylindrical seat 20 is further provided with an outer threaded portion 23.

The sleeve 30 is provided with an inner threaded portion 31 engageable with the outer threaded portion 23 of the cylindrical seat 20. The sleeve 30 is further provided in the inner wall of the top end thereof with an annular retaining projection 32. The sleeve 30 is rotatably fastened with the cylindrical seat 20 such that the inner threaded portion 31 of the sleeve 30 is engaged with the outer threaded portion 23 of the cylindrical seat 20.

Figure 4:
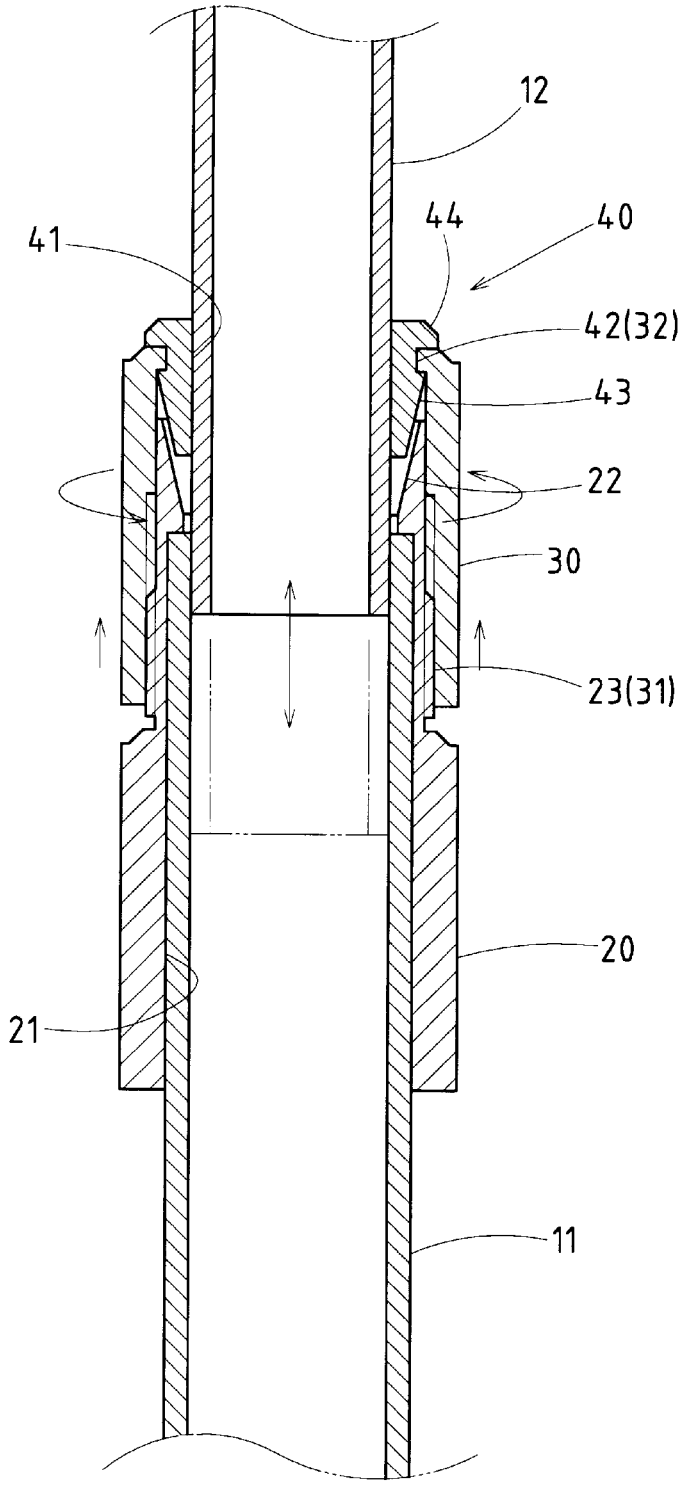
FIG. 4 shows a longitudinal sectional view of the expandable unit of the preferred embodiment of the present invention in the movable state.
Figure 5:
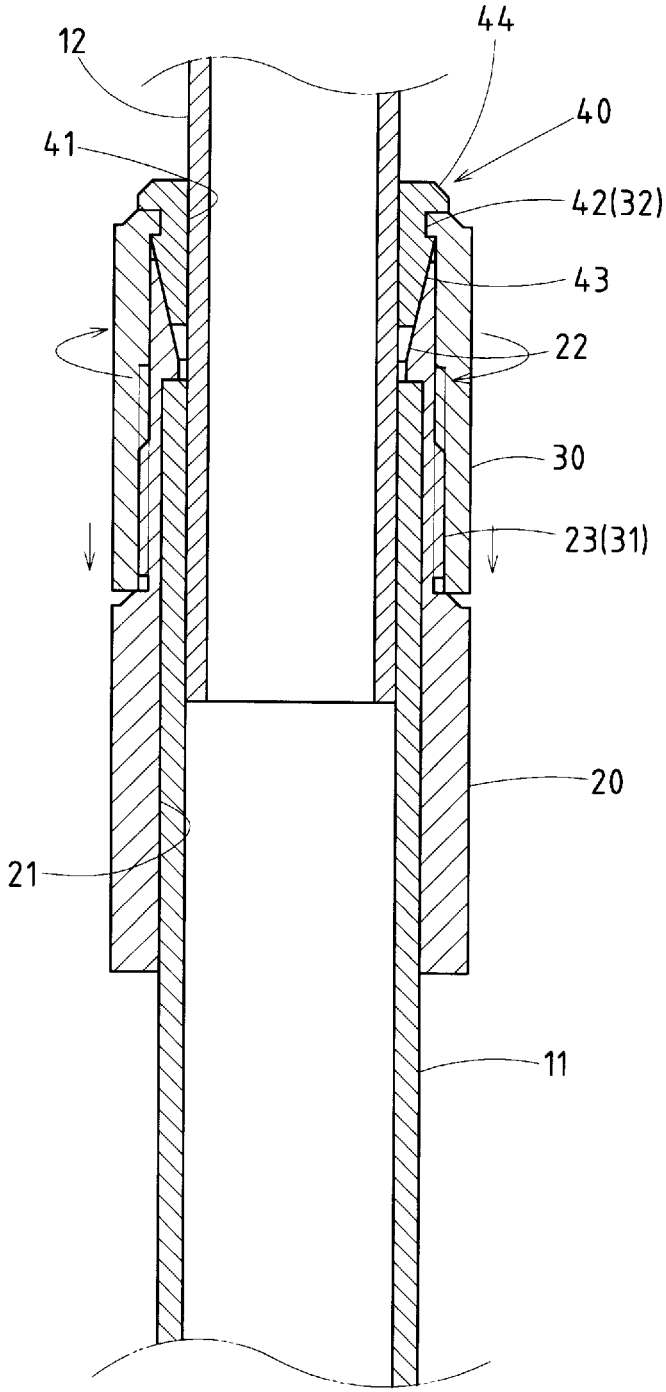
FIG. 5 shows a longitudinal sectional view of the expandable unit of the preferred embodiment of the present invention in the fixed state.

The lock ring 40 is made of an elastic material, such as rubber, and is provided with a flange 44, and a tightening portion 43 of a tapered construction and extending from the flange 44. The lock ring 40 is further provided in the outer wall with an annular retaining groove 42 which is located between the flange 44 and the tightening portion 43. The lock ring 40 is retained in the top end of the sleeve 30 such that the retaining projection 32 of the sleeve 30 is retained in the retaining groove 42 of the lock ring 40, and that the tightening portion 43 of the lock ring 40 is fitted into the receptacle 22 of the cylindrical seat 20, as shown in FIGS. 4 and 5. It must be noted here that the lock ring 40 is provided with a center through hole 41, which extends through the tightening portion 43.

The expandable unit 10 is assembled in such a way that the bottom end of the inner tube 12 is slidably fitted into the top end of the outer tube 11 through the lock ring 40, the sleeve 30 and the cylindrical seat 20, and that the bottom end of the inner tube 12 is embraced by the tightening portion 43 of the lock ring 40, as shown in FIG. 4. The bottom end of the inner tube 12 can be moved up and down inside the top end of the outer tube 11, so as to adjust the height of the horizontal bar 06. The bottom end of the inner tube 12 is located by turning the sleeve 30 in the clockwise direction, as illustrated in FIG. 5. As a result, the lock ring 40 is carried along with the sleeve 30 to move toward the cylindrical seat 20 so as to force the tightening portion 43 of the lock ring 40 to move further into the receptacle 22 of the cylindrical seat 20. In light of the elasticity of the lock ring 40, the tightening portion 43 of the lock ring 40 is pressed by pressure to embrace tightly the inner tube 12, which is thus located securely. In another words, the bottom end of the inner tube 12 can not be moved up and down in the inside of the outer tube 11. If a readjustment is called for, the sleeve 30 is turned in the counterclockwise direction, as shown in FIG. 4. As a result, the lock ring 40 is carried along with the sleeve 30 to move in the direction away from the cylindrical seat 20, so as to cause the tightening portion 43 of the lock ring 40 to separated from the receptacle 22 of the cylindrical seat 20. The tightening portion 43 of the lock ring 40 is thus relieved of the pressure to become less compact. In another words, the inner tube 12 is no longer embraced tightly by the tightening portion 43 of the lock ring 40 and can be therefore moved up and down in the inside of the outer tube 11.

The embodiment of the present invention described above is to be regarded in all respects as being illustrative and nonrestrictive. Accordingly, the present invention may be embodied in other forms without deviating from the spirit thereof. The present invention is therefore to be only by the scope of the following claims.

I claim:

1. A rack comprising:

a base;

a plurality of expandable units, each unit being fastened uprightly on said base and comprised of an outer tube, an inner tube, and a locating structure, said outer tube being fastened at a bottom end to said base, said inner tube being slidably fitted at a bottom end into a top end of said outer tube in conjunction with said locating structure; and one or more horizontal bars, each bar being adjustably supported by a top end of said inner tube of said expandable units;

wherein said locating structure comprises:

a cylindrical seat provided in an interior with a longitudinal slot, in a top end with a tapered receptacle in communication with and in alignment with said longitudinal slot, and in an outer wall with an outer threaded portion whereby said longitudinal slot is dimensioned to receive the top end of said outer tube, a sleeve comprised of an inner threaded portion, and in an inner wall of a top end, an annular retaining projection whereby said sleeve is rotatably fastened to said cylindrical seat such that said inner threaded portion of said sleeve is engaged with said outer threaded portion of said cylindrical seat; and a lock ring comprised of an elastic material and comprised of a flange, a tightening portion of a tapered construction and extending from said flange, an annular retaining groove located between said flange and said tightening portion, and a center through hole extending from said flange through said tightening portion, said lock ring being retained in the top end of said sleeve such that said retaining projection of said sleeve is retained in said retaining groove of said lock ring, and such that said tightening portion of said lock ring is extended into said receptacle of the top end of said cylindrical seat, and such that said tightening portion of said lock ring embraces the bottom end of said inner tube whereby said tightening portion is pressed thereagainst by said receptacle to become compact so as to embrace the bottom end of said inner tube when said sleeve is turned clockwise in relation to said cylindrical seat, said tightening portion of said lock ring being capable of relaxing when said sleeve is turned counterclockwise in relation to said cylindrical seat, thereby enabling the bottom end of said inner tube to be moved up and down inside the top end of said outer tube.

2. The rack as defined in claim 1, wherein said lock ring is comprised of rubber.

* * * * *